US008931494B2

(12) United States Patent
Weis et al.

(10) Patent No.: US 8,931,494 B2
(45) **Date of Patent: *Jan. 13, 2015**

(54) CLEANING CONTAINER

(75) Inventors: Norbert Weis, Heddesheim (DE); Ralf Juergens, Laudenbach (DE); David McKnight, Hinsdale, IL (US)

(73) Assignee: Carl Freudenberg KG, Weinheim (DE)

( * ) Notice: Subject to any disclaimer, the term of this patent is extended or adjusted under 35 U.S.C. 154(b) by 1888 days.

This patent is subject to a terminal disclaimer.

(21) Appl. No.: 11/874,688

(22) Filed: Oct. 18, 2007

(65) Prior Publication Data

US 2008/0210267 A1 Sep. 4, 2008

Related U.S. Application Data

(60) Provisional application No. 60/853,252, filed on Oct. 20, 2006.

(51) Int. Cl.
*A47K 11/00* (2006.01)
*A46B 17/06* (2006.01)
*A47K 17/00* (2006.01)

(52) U.S. Cl.
CPC ..... *A46B 17/06* (2013.01); *A47K 17/00* (2013.01); *A46B 2200/304* (2013.01)
USPC ..... 134/44

(58) Field of Classification Search
CPC ..... A47K 11/00
USPC ..... 134/44
See application file for complete search history.

(56) References Cited

U.S. PATENT DOCUMENTS

| | | | | | |
|---|---|---|---|---|---|
| 4,211,750 | A | * | 7/1980 | Gillespie | 422/123 |
| 5,945,076 | A | | 8/1999 | Leonard et al. | |
| 5,958,150 | A | * | 9/1999 | Borger et al. | 134/42 |
| 6,804,839 | B1 | | 10/2004 | McMaster | |

FOREIGN PATENT DOCUMENTS

| | | | | | |
|---|---|---|---|---|---|
| DE | 1868032 | U | | 2/1963 | |
| DE | 19804064 | A1 | | 8/1999 | |
| DE | 19804064 | A1 | * | 8/1999 | A47K 11/10 |
| DE | 2004013355 | | * | 11/2005 | A46B 17/06 |
| DE | 102004013355 | B3 | | 11/2005 | |
| FR | 1072086 | | * | 9/1954 | A47K 11/10 |
| FR | 2827754 | A1 | * | 1/2003 | A47K 11/00 |
| WO | WO2005/095723 | A1 | * | 10/2005 | E03D 9/06 |

* cited by examiner

*Primary Examiner* — Michael Barr
*Assistant Examiner* — Jason Riggleman
(74) *Attorney, Agent, or Firm* — Leydig, Voit & Mayer, Ltd.

(57) ABSTRACT

A cleaning container (1) for a cleaning device (4) is provided. The cleaning device has a handle (6) and a cleaning head (5). The cleaning container includes a main chamber (3) for the cleaning and storing of the cleaning device (4) and a secondary chamber (13), connected to the main chamber (3) via an access opening (16). A device for the action of the cleaning fluid on the cleaning device (4) in the main chamber (3) is provided. The main chamber (3) and the second chamber (13) are designed as separate container elements (2, 12), which are connected to one another in a detachable manner.

7 Claims, 2 Drawing Sheets

CLEANING CONTAINER

FIELD OF THE INVENTION

The invention concerns a cleaning container for a cleaning device, which has a handle and a cleaning head, in particular, for a toilet brush.

BACKGROUND OF THE INVENTION

A cleaning container of the generic type is known from DE 198 04 064 A1. The known cleaning container for a toilet brush has a main chamber to store and clean the toilet brash. The main chamber is connected, via an opening, to a secondary chamber, in which a spray bottle or a dispenser with a disinfecting gas or a disinfecting liquid is found. Furthermore, an opening mechanism is provided for the spray bottle or the dispenser, which is operated either manually or by a corresponding lever or cam on the brush head or on the handle when the toilet brush is inserted into the main chamber. When the opening mechanism is actuated, disinfecting liquid or a disinfecting gas exits from the spray bottle or dispenser and arrives through the aforementioned opening between the chambers at the brush head. The actuation of the opening mechanism takes place against the force of a spring, so that the spray bottle or the dispenser is in the opening position for only a short period of time. By exposing the brush head to the disinfecting agent within the relatively limited space of the cleaning chamber, it should be possible to free the brush head of bacterial impurities within a few hours in accordance with the publication. Agents commonly used for the cleaning of toilets should be applicable as the disinfecting agent.

The disadvantage in the known cleaning container is that it is not possible to rule out the accumulation of impurity residues or residues of the disinfecting agent on the bottom of the main chamber in the course of time to contaminate it. The publication does not provide for a cleaning of the container. In any case, however, such a cleaning would be very expensive. The entire bulky container would have to be turned upside down, after the dismantling of the spray bottle or the dispenser, and would have to be rinsed out. With this cumbersome handling, the introduction of impurity residues into the environment cannot be ruled out.

SUMMARY OF THE INVENTION

The problem that the invention is based on is to further develop a cleaning container of the generic type so that a cleaning of the cleaning container itself, after its use, with simple means and under hygienic conditions, is readily possible.

In accordance with the invention, provision is made in a cleaning container for a cleaning device which has a handle and a cleaning head, in particular, for a toilet brush, wherein the cleaning container comprises a main chamber for the cleaning and storing of the cleaning device and a secondary chamber, connected to the main chamber via an access opening, with a device for the action of the cleaning device with a cleaning fluid in the main chamber, so that the main chamber and the secondary chamber are designed as separate container elements, which are connected in a detachable manner to one another.

In a surprising manner it has been shown that this simple constructive measure is sufficient to make possible an emptying and cleaning of the cleaning container in a simple and hygienic manner. For the emptying and cleaning, the container element with the main chamber is loosened in a simple manner from the container element with the secondary chamber with the cleaning fluid and is separately cleaned. Other parts need not be broken down or dismantled. Following the cleaning, the two container elements can be simply connected to one another once again. Another advantage of the cleaning element in accordance with the invention is that the container element with the main chamber can be shaped geometrically very simply, for example, like a pot, so that it can be cleaned in a very simple manner. Also since the size of the container element will not substantially exceed the size of a brush head to attain as high as possible a concentration of cleaning fluid in the main chamber with a metering as economical as possible, a rinsing in a bath with a cleaning liquid is readily possible also.

Advantageously, the two container elements are connected to one another via a plug connection. Then it is possible to detach the two parts from one another very easily with a minimum expenditure of force or to connect them to one another once again.

In a particularly preferred embodiment of the invention, the container element with the device for the action with a cleaning fluid in the cleaning device is designed as a base body, on which the container element with the main chamber can be installed. For such an arrangement, it is possible to have not only a very attractive optical design, but the arrangement can have, in particular, the advantage that the container element to be cleaned can be lifted up in a simple manner. Also a change of the container with the cleaning fluid is readily possible in this manner. Furthermore, the base container can be designed wider than the container element with the main chamber, so that a secure and firm stand of the entire cleaning container is thus guaranteed, without detriment to the optical impression or without the entire cleaning container turning out to be excessively voluminous.

In order to prevent volatilization of the cleaning fluid from the cleaning container, the container element with the main container can be preferably sealed.

The sealing can, for example, take place with a cover element, which is found on the handle of the cleaning device and which can be set on its rim area when the cleaning device is inserted into the main chamber from above. The cover element can be shaped as one piece on the handle or be constructed separately and be affixed on it in a detachable or nondetachable manner. Furthermore, the sealing effect can also be increased by means of a sealing ring.

In another preferred embodiment of the invention, provision is made so that the main chamber can be sealed by means of two half-shell elements that are articulated on the upper circumferential area of the base body and that can swivel toward one another. This embodiment has not only the advantage that a very attractive optical effect is obtained when opened and also when closed, but also the additional advantage that the affixing of a cover element on the handle of the cleaning device is not required, wherein the latter is simpler to handle. Also, a replacement with a cleaning device which does not have a completely identical configuration is more likely than in the case of the integrated cover element described above.

Another advantage is to be found in the fact that this relatively simple constructive measure makes it possible for the entry opening to be large enough with opened half-shell elements so that an insertion from above of the cleaning device in a vertical position is possible without any problems. Since the half-shell elements in an opened position form a kind of funnel with walls that expand in an essentially conical manner upwards, drops that may fall are caught and are conducted into the interior of the container. In no way is there an undesired and unaesthetic soiling of the outside walls of the cleaning container.

In another preferred embodiment of the invention devices can be provided which lead to an automatic swivelling of the two half-shell elements into their sealing position when the cleaning device is inserted. Such devices are known to the person skilled in the art. They can comprise, for example, lifting elements. For automatic opening when the cleaning device is taken out, the half-shell elements can be constructed and arranged in such a way that they swivel apart merely as a result of gravity when the pressure on the lifting elements is eliminated.

Devices for the action of the cleaning liquid on the cleaning device preferably comprise, as is known from the state of the art, a spray bottle, a cartridge, or a dispenser with cleaning fluid. The storage and purposeful metering of the cleaning fluid is particularly simple in these cases. The spray bottle or the cartridge or the dispenser must be placed in a secondary chamber within the corresponding container element of the cleaning container, so that the cleaning fluid can arrive at the cleaning device to be cleaned via the common access opening into the main chamber. There are no other limitations with respect to the geometric arrangement. Thus, the placement of the secondary chamber, for example, can be done either centrally or noncentrically relative to the main axis of the cleaning container. Advantageously, however, the cleaning head of the cleaning element is impinged on by the cleaning fluid from below, as is known from the state of the art, so as to attain the best possible cleaning result.

The metering of the cleaning fluid can take place simply by triggering of the opening mechanism already present in spray bottles, cartridges, or dispensers, for example, by pressing down on the head of the spray bottle or of the cartridge or of the dispenser.

The actuation of the spray bottle, the cartridge, or the dispenser can be done manually in a simple manner. Preferably, however, with a cleaning container in accordance with the invention, an actuation mechanism is provided for automatic actuation of the spray bottle, the cartridge, or the dispenser or another device for the impingement of the cleaning fluid on the cleaning device, which can be triggered, for example, by inserting the cleaning device in the cleaning container. Such automatic actuation mechanisms are in fact known. As a rule they are based on the provision of projections, levers, or the like on the cleaning container, which are located in such a way that they lead to a triggering of the opening mechanism when the cleaning device is inserted into the cleaning container, for example, the opening mechanism of the spray bottle, the cartridge, or the dispenser, in particular, by pressing down on the head of the spray bottle, the cartridge, or the dispenser.

Furthermore, advantageously, an automatic restoration mechanism to close the spray bottle, the cartridge, or the dispenser is also provided after the brief exiting of cleaning fluid or some other device for the action of the cleaning fluid on the cleaning device. Also, such restoration mechanisms are in fact known. For the sake of simplicity, spring elements are used for this purpose, which act against the movement for the triggering of the actuation mechanism.

In another preferred embodiment of the invention, a time switch for the actuation of the opening mechanism is provided. In this way, it is possible, in particular during longer storage periods, to undertake a cleaning at regular, freely adjustable time intervals without using the cleaning device. If the cleaning fluid used also contains fragrances, a regular room deodorizing is thereby attained as a secondary effect as a result of the nonhermetic sealing of the cleaning container.

The cleaning container described above is to be used, in particular, in the field of sanitary uses, with particular preference for the cleaning of toilet brushes.

In general, the cleaning container in accordance with the invention is suitable, however, for the hygienic cleaning and storage of all types of cleaning devices, which are characterized by a handle and a cleaning head, for example, also for the cleaning of toothbrushes.

The cleaning container in accordance with the invention can be used not only for the cleaning of brushes; in principle, it is also suitable for those cleaning devices in which the cleaning head is not designed as a brush, but rather as a molded body from a foam or a nonwoven or the like.

All cleaning agents conceivable in the sanitary area are suitable as a cleaning fluid.

In particular for use in the toilet area, cleaning fluids are preferred that contain so-called "drying accelerators"—that is, for example, liquids that mix with water with the formation of an azeotrope. For example, alcohols, in particular ethanol or isopropyl alcohol, are suitable as such drying accelerators.

Furthermore, cleaning fluids that can be used within the scope of the invention have antibacterial/antimicrobial substances in a manner which is, in fact, known—in particular, quaternary ammonium salts, such as octyldecyldimethylammonium chloride, dioctyldimethylammonium chloride, didecyldimethylammonium chloride, alkyldimethylbenzylammoniun saccharinates, such as phenols, like, for example, o-phenyl phenol, o-benzyl-p-clorophenol, triclosane, silver and silver salts, hydrogen peroxide, free or in a bound form, hypochlorites, chlorine, free and in a bound form, As mentioned above, the cleaning fluid can also contain additions of fragrances.

A particularly preferred cleaning agent contains the following: 0.1% alkyl[50% C(14), 40% C(12), 10% C(16)]dimethylbenzyl ammonium saccharinate 79% ethanol 20.9% additional and inert additives.

In addition to the device described above for the action of a cleaning fluid on the cleaning device, other devices such as lamps for fluorescent light for the killing of bacteria or the like, can also be provided for the cleaning of the cleaning device.

The invention is explained in more detail below with the aid of embodiment examples shown in the figures: Shown are:

DETAILED DESCRIPTION OF THE PREFERRED EMBODIMENTS

Figure 1:
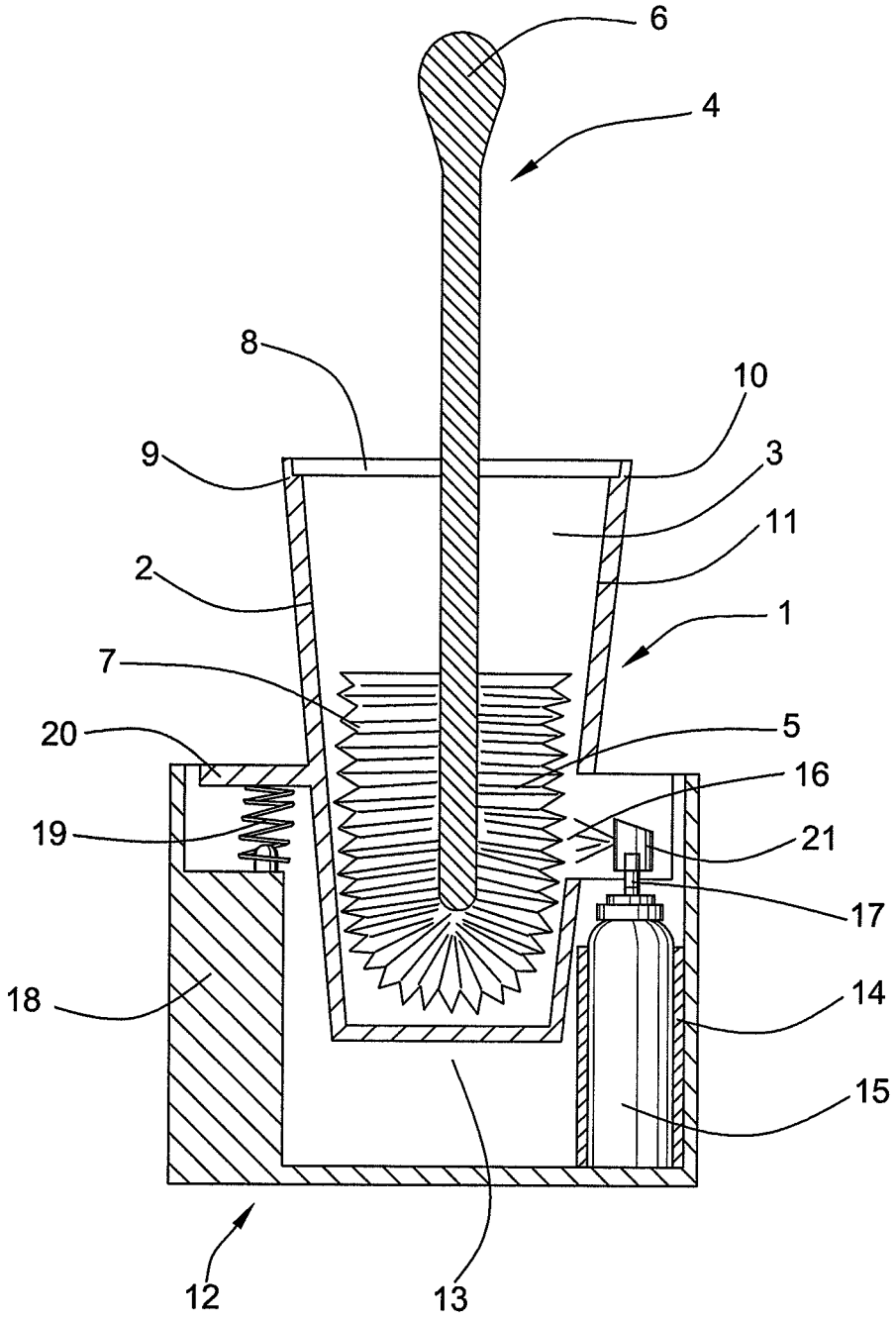
FIG. 1 is a schematic longitudinal section view of a cleaning container in accordance with a first preferred embodiment of the invention.

In FIG. 1, one can see a cleaning container 1 with a first container element 2 with a main chamber 3, in which a cleaning device 4 with a cleaning head 5 and a handle 6 is found. The cleaning device 4 is a toilet brash without limitation of its general features in the embodiment shown. The bristles of the cleaning head 5 are designated by the reference symbol 7. The main chamber 3 is closed toward the outside and sealed by means of a cover element 8, which is placed on the handle 6 of the cleaning device 1. An additional sealing is also effected by the sealing ring 9, which lies on a step-like offset 10 in the interior area of the wall 11 of the container element 2.

In the figure, a second container element is designated by the reference symbol 12. It has a secondary chamber 13. A spray bottle 15 with a cleaning fluid is located laterally in a hollow cylindrical holder 14 in the secondary chamber 13. The main chamber 3 and the secondary chamber 13 are connected to one another via an access opening 16 at the level of the head 17 of the spray bottle 15. Furthermore, there is also a support element 18 with a spring element 19, whose function will be discussed in more detail below, in the secondary chamber 13.

In the figure, one can see that the main chamber 3 and the secondary chamber 13 are designed as separate container elements 2, 12 in accordance with the invention. In particular, the container element 2 is inserted into the container element 12 in the embodiment shown. The container element 2 is hereby supported on the head 17 of the spray bottle 15 and on the supporting element 18 with the spring element 19. Appropriately, several support elements 18 distributed over the circumference of the container element 12 can be provided with spring elements 19. To empty or to clean or to replace the spray bottle 15, the container element 2 is lifted out and upwards from the container element 12 in a simple manner. Following the cleaning process or after replacing the spray bottle 15, the container element 2 can be inserted once more into the container element 12 from above.

The container element 12 has a somewhat larger cross-sectional area than that of the container element 2 that limits the main chamber 3 and thus forms a kind of base body for the container element 2, wherein a higher stability is attained.

In its lower area the container element 2 has on its outside circumference a curtain 20 extending horizontally outwards, which is used as a rest on the supporting elements 18 with the spring bodies 19 and on the head 17 of the spray bottle 15. The curtain 20 has an axial extension in the area of the head 17 of the spray bottle 15, which extension serves as an actuation element 21 for the spray bottle 15. The container element 2 is pressed briefly downwards against the spring force of the spring bodies 19 by briefly exerting pressure on the handle 6 of the cleaning device 4. The head 17 of the spray bottle 15 is also pressed downwards with the result that cleaning fluid exits briefly and arrives in the main chamber 3, with the cleaning head 5 via the access opening 16. Since the main chamber 3 is sealed off toward the outside as described above, the cleaning fluid acts in such a high concentration on the cleaning head 5 of the cleaning device 4 that after a short time, a very good disinfecting effect is attained.

Figure 2:
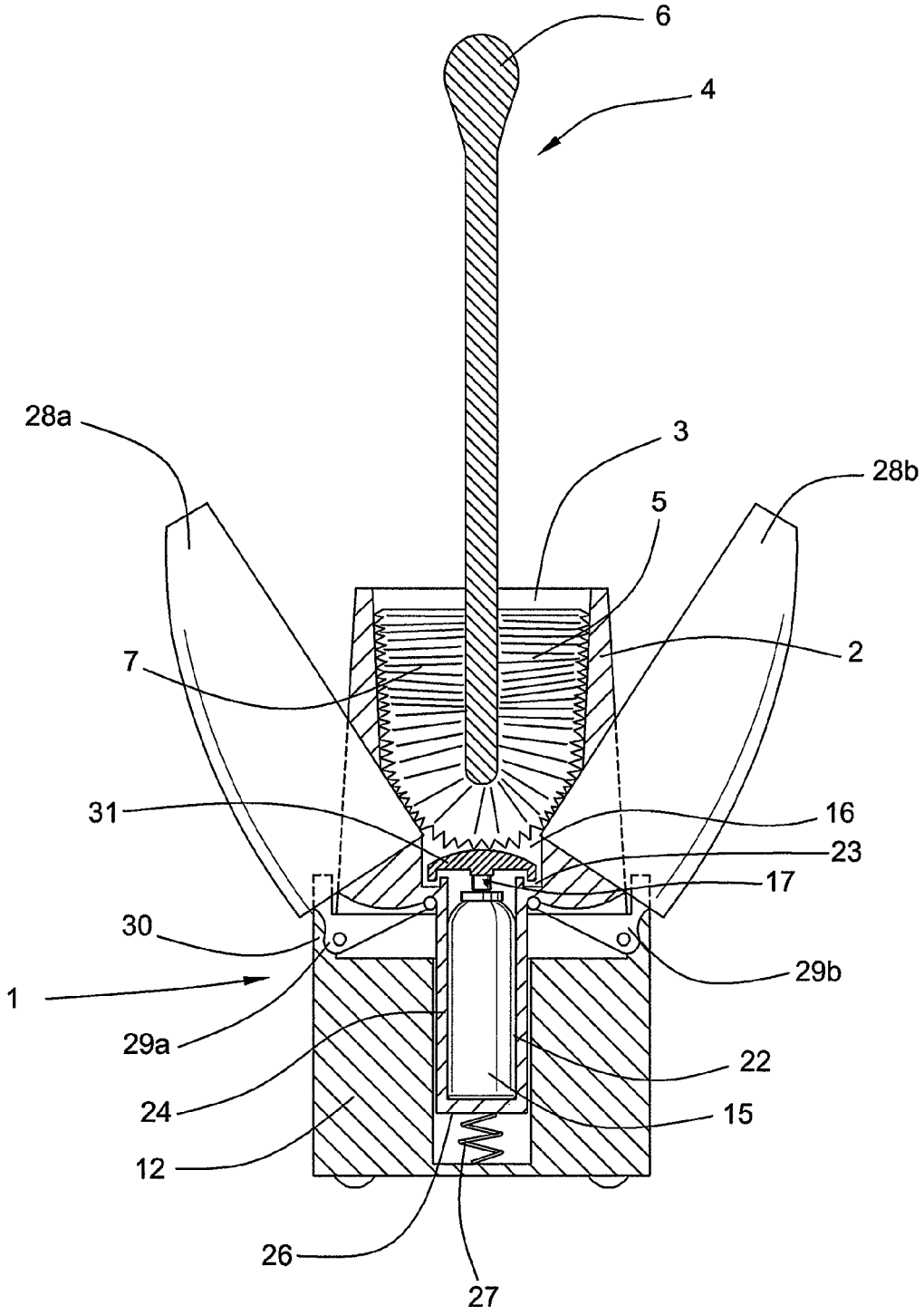
FIG. 2 is a schematic longitudinal section view of a cleaning container in accordance with a second preferred embodiment of the invention.

FIG. 2 shows another preferred embodiment of the invention. The same parts are provided with the same reference symbols. In the embodiment shown in FIG. 2, the secondary chamber for the spray bottle 15 is formed in the container element 12 by a centrally located, hollow, cylindrical holding fixture 22. The hollow cylindrical holding fixture 22 is followed upwards by a radial expansion 23 for holding of the container element 2. The access opening 16 to the main chamber 3 of the container element 2 is located in the bottom of the container element 2 directly above the head 17 of the spray bottle 15, so that when the opening mechanism for the spray bottle 15 is actuated, the cleaning fluid is sprayed in from below into the main chamber 3 with the cleaning head 5.

The hollow, cylindrical holding fixture 22 for the spray bottle 15 and the radial expansion 23 for the insertion of the container element 2 are limited by the actuation element 24, which can be inserted into a corresponding holding fixture 26 in the container element 12 and can be displaced downwards in a vertical direction relative to the container element, against the force of the spring element 27 located at the bottom of the container element 12. This arrangement makes possible an automatic closure of the container 2 when the cleaning device 4 is inserted, as is described below.

For the closure and sealing, two half-shell elements 28*a*, 28*b*, which are articulated on the upper circumferential area of the container element 12 and which can swivel toward one another, are provided in the depicted embodiment. Both are in an open position in the figure. For automatic swiveling into the closed position when the cleaning device 4 is inserted into the main chamber 3, lifting elements 29*a*, 29*b*, which are firmly connected to the half-shell elements 28*a*, 28*b*, are provided, and are articulated both on the container element 12 in the area of the radial expansion on the inside wall 30 and also on the actuation element 24.

When pressure is exerted from above onto the container element 2, for example, when placing the cleaning device 4 in the main chamber 3, said element is moved downwards and exerts a corresponding pressure in the same manner onto the actuation element 24, which is also moved downwards against the spring force of the spring element 27. By this movement of the actuation element 24, the lifting elements 29*a*, 29*b*, which are articulated on the actuation element 24, are tilted downwards, which leads to a swiveling movement of the half-shell elements 28*a*, 28*b*, in the direction of their closed position. In the ideal case, the spring force of the spring element 27 and the weight of the cleaning device 4 are coordinated with respect to one another in such a way that the insertion of the cleaning device 4 only leads to the closure of the container element 2, so that only with a further exertion of pressure on the handle 6 of the cleaning device 4 is there a triggering of the opening mechanism of the spray bottle 15. This has the advantage that the cleaning device 4 can be stored in the closed container element 2, without automatically triggering the opening mechanism of the spray bottle 15.

In the depicted embodiment, the spray bottle 15 projects so far into the holding fixture for the container element 2 in the area of the radial expansion 23 that by additional brief pressing down after the insertion of the cleaning device 4 into the main chamber 3 and by swiveling of the half-shell elements 28*a*, 28*b* into their closed position, the spray head 17 is also briefly pressed down, with the result that cleaning fluid is briefly sprayed upwards into the main chamber 3.

One can also see in the figure that the bottom 31 of the container element 2 is elevated in the area of the access opening 16, so as to prevent a running out of liquid through the access opening 16.

The invention claimed is:

1. A cleaning container for a cleaning device having a handle and a cleaning head, the cleaning container comprising: a first container element including a main chamber for the cleaning and storing of the cleaning device and second container element including a secondary chamber that is connected to the main chamber via an access opening, the secondary chamber including a device comprising a spray container with cleaning fluid for directing a cleaning fluid on the cleaning device in the main chamber of the first container element, and an actuation mechanism for actuating the spray container, the actuating mechanism being triggerable by insertion of the cleaning device into the main chamber, wherein the first and second container elements are connected to one another in a detachable manner, wherein the first container element is at least partially inserted in the second container element and the first container element has a relatively smaller cross-sectional area than the second container element such that the second container element including the device for directing the cleaning fluid on the cleaning device comprises a base body on which the first container element including the main chamber is supportable.

2. The cleaning container according to claim 1, wherein the first container element including the main chamber is sealable off.

3. The cleaning container according to claim 2, wherein the first container element including the main chamber is sealable off by a cover element that is arranged on the handle of the cleaning device, the cover element being positionable on a rim area of the main chamber when the cleaning device is inserted into the main chamber from above.

4. The cleaning container according to claim 2, wherein the main chamber of the first container element is sealable off by two half-shell elements that are articulated on a upper circumferential area of the base and that are pivotable toward one another.

5. The cleaning container according to claim 4, further including a mechanism for producing an automatic sealing off of the main chamber by the two half-shells when the cleaning device is inserted.

6. The cleaning container according to claim 1, further including a restoring mechanism for closing of the spray container after a brief discharge of cleaning fluid is provided.

7. The cleaning container according to claim 6, wherein the restoring mechanism includes a spring.

* * * * *